United States Patent [19]

Taniguchi et al.

[11] Patent Number: 4,954,746

[45] Date of Patent: Sep. 4, 1990

[54] THIN FILM ELECTROLUMINESCENCE DISPLAYING APPARATUS

[75] Inventors: Kouji Taniguchi; Takashi Ogura; Koicji Tanaka, all of Nara, Japan

[73] Assignee: Sharp Kabushiki Kaisha, Osaka, Japan

[21] Appl. No.: 235,450

[22] Filed: Aug. 23, 1988

[30] Foreign Application Priority Data

Aug. 31, 1987 [JP] Japan ..... 62-218923

[51] Int. Cl.[5] ..... H05B 33/02

[52] U.S. Cl. ..... 313/506; 313/509

[58] Field of Search ..... 313/506, 509

[56] References Cited

U.S. PATENT DOCUMENTS

| | | | |
|---|---|---|---|
| 2,867,739 | 1/1959 | Michlim | 313/506 X |
| 3,015,747 | 1/1962 | Rosenberg | 313/506 X |
| 3,289,198 | 11/1966 | Dickson, Jr. et al. | 313/506 X |
| 4,188,565 | 2/1980 | Mizukami et al. | 313/509 |
| 4,801,844 | 1/1989 | Barrow et al. | 313/509 |

*Primary Examiner*—Sandra L. O'Shea

[57] ABSTRACT

A thin film EL displaying apparatus includes a first thin film EL element and a second thin film EL element. Each element is composed of an EL layer sandwiched between a pair of upper and lower electrodes, a first and a second substrates provided respectively with the first and the second thin film EL elements, and an insulating film on the upper and lower surfaces on which conductive films for leads are formed. The first and the second substrates are laminated in a manner that the first and the second thin film EL elements face each other and the insulating films are sandwiched therein. The insulating film is disposed such that one end of each of the conductive films on upper and lower surface thereof is brought in contact with, and is electrically connected to the upper electrode or lower electrode of the first EL element and the respectively corresponding electrode of the second EL elements. The other end of each of the conductive films can be connected to an external driving circuit.

22 Claims, 5 Drawing Sheets

THIN FILM ELECTROLUMINESCENCE DISPLAYING APPARATUS

BACKGROUND OF THE INVENTION

1. Field of the Invention

The present invention relates to a thin film electroluminescence element wherein a luminescent layer is sandwiched between electrodes. It specifically relates to a panel configuration for performing multicolored luminescence by superposing a plurality of substrates wherein thin film electroluminescence elements emitting light of different colors are formed respectively.

2. Description of the Prior Art

For a luminescent element used for a luminescent display, a surface light source or similar light source is utilized. An AC-driven-type high-brightness thin film electroluminescence element (hereinafter electroluminescence is referred to as EL) has been put to practical use in such a display wherein a thin film EL layer, with an active material added, is sandwiched between electrodes. The color of luminescence is determined by the kinds of material of the luminescence layer and the active material added thereto. For example, a yellow-orange luminescence is obtained by adding Mn into a ZnS film; a green luminescence is obtained by adding Tb thereto; and a red luminescence is obtained by adding Eu into a CaS film. In the case of a multicolored display being achieved by using these thin film EL elements, two systems are employed. That is, a system wherein elements having luminescent layers emitting light of different colors are formed on the same substrate and a further system wherein different substrates are used for each element emitting light of a different color (for example, refer to the U.S. Pat. No. 4,396,864).

FIG. 9 is a configuration diagram of a double-layer-structure thin film EL panel wherein conventional EL elements are formed on different substrates on a luminescence color basis.

Lower electrodes 2 and 12 configure matrix electrodes; lower insulating layers 3 and 13 are formed; and luminescent layers 4 and 14 emitting light of different colors are laminated sequentially on two sheets of top and bottom glass substrates 1 and 11; and further on the luminescent layers 4 and 14, upper insulating layers 5 and 15 and upper electrodes 6 and 16 are laminated in sequence. Each electrode of the matrix electrodes is connected to driving circuits A1, A2, B1 and B2 of independent power sources based on an electrode group basis. Each of the upper and lower thin film EL elements is driven to emit light independently in response to an application of voltage to each of the matrix electrodes.

In the case where elements having EL layers emitting light of different colors are formed on the same substrate, the color displaying apparatus can be fabricated, theoretically, by means of making the structure multilayered. However, this brings forward problems of productivity, yield rate, reliability of the element and compounds as well as being practically difficult to fabricate. On the other hand, in the case where the EL elements are fabricated by using different substrates on a luminescence color basis, it is believed that this is promising but has not been technically studied. The present invention relates to the latter case, and proposes a solution for the problems of the cost and quality of display in practical use as described below.

(i) Cost

The thin film EL panels are often comprise a driving system of an XY-matrix consisting of scanning electrodes and data electrodes. Further, these electrodes are required to be driven independently so as to be able to display an arbitrary pattern.

Since the number of electrodes is very large, the ratio of the cost of a driving circuit applying voltage to these electrodes to the total cost of the entire displaying apparatus is relatively large. When the elements are configurated respectively on a plurality of substrates and the elements are driven on a substrate basis, the cost of the driving circuit increases in proportion to the number of substrates. This raises the cost of the displaying apparatus substantially, and makes it difficult to put the apparatus to practical use. Also, not only does the increase in the number of parts raise the cost, but also, this has a remarkably adverse effect on the productivity.

(ii) Quality of Display

In the multicolored thin film EL apparatus wherein the substrates are superposed, a problem in the quality of display occurs in that since the luminescent surfaces are not on the same plane, the state of their superposition depends on the angle of view, and thereby the quality of display might be deteriorated.

SUMMARY OF THE INVENTION

The present invention is concerned with a thin film EL displaying apparatus comprising a first thin film EL element, and a second thin film EL element. Each element is composed of an EL layer sandwiched between a pair of upper and lower electrodes. A first and a second substrate is provided with the first and the second thin film EL elements respectively. Further, an insulating film is formed on the front and rear surfaces of the luminescent layer which conductive films for leads are further formed. The first and the second substrates are then laminated in a manner such that the first and the second thin film EL elements face each other and the insulating films are sandwiched therein. Each of the insulating films are disposed such that one end of each of the conductive films on front and rear surface thereof are brought into contact with, and is electrically connected to, the upper electrode or lower electrode of the first EL element and the respectively corresponding electrode of the second EL elements. The other end of each of the conductive films can be connected to an external driving circuit.

The conductive film on the front and rear surfaces of the insulating film are preferably connected electrically.

In accordance with the present invention, in the case of a multicolored luminescence panel being configurated by superposing a plurality of substrates (S sheets) and N lines of scanning electrodes installed on each substrate, the number of connecting lines between the scanning electrodes and the driving circuit does not become $N \times S$ but can be left at N, remaining intact by connecting the corresponding scanning electrodes of the EL elements. Consequently the cost of the driving circuit connected to the scanning electrodes can be reduced. In the case where the substrate surfaces whereon the films configurating the elements are formed are superposed so as to face each other to configurate a multicolored luminescence panel, the narrower the space between the substrates is, the more the change in the quality of display due to the angle of view can be reduced. On the other hand, wirings are required to connect the electrodes of each substrate to the driving circuit. In order to simultaneously meet these requirements, the conductive films for connecting the electrodes on the substrate to the driving circuit are installed on both surfaces of the insulating film, and this film is disposed between the substrates to make connection between the display element and the driving circuit. This film is can easily be made satisfactorily thin, for example, of a thickness of 100–500 μm, so as not to cause a problem of the quality of display.

Then, to the display panel incorporating the thin film EL elements, various seals are applied to eliminate effects of external moisture and other outside elements and to secure the reliability thereof. For example, in a monochromatic EL display panel, the substrate side whereon an EL film is formed, is covered with glass (seal glass), and an insulating oil having also moisture-resisting property is sealed therein.

In the multicolored EL panel wherein the substrates are superposed, one substrate can be used as part of a glass seal. However, a closed space is required to be formed between the substrates. By utilizing the above-described film for this purpose, the processes of sealing the EL panel and drawing out the electrodes can be performed simultaneously. This greatly effects the productivity as well as the cost and quality of the display.

DESCRIPTION OF THE PREFERRED EMBODIMENTS

Hereinafter, a detailed description is made of the present invention based on various embodiments.

Figure 1:
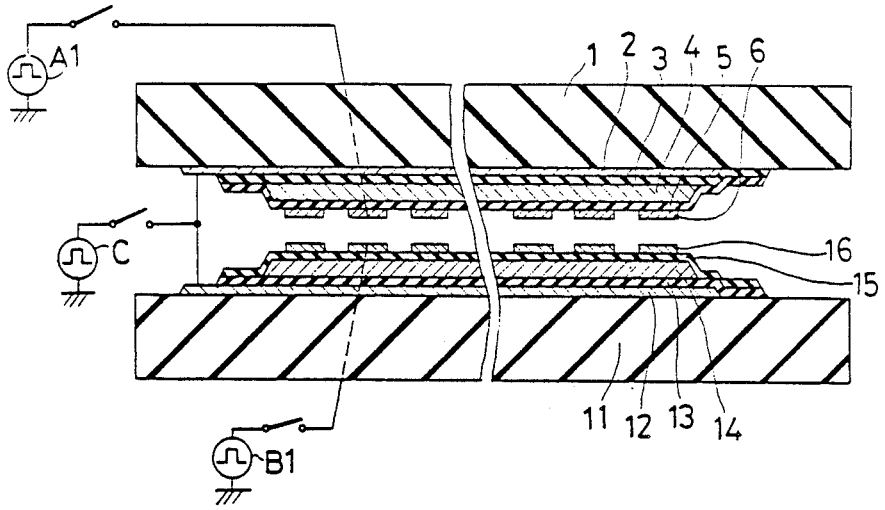
FIG. 1, FIG. 2, FIG. 6, FIG. 7 and FIG. 8 are structural cross-sectional views showing embodiments in accordance with the present invention.

FIG. 1 is a configuration diagram of a matrix type multicolored EL panel showing one embodiment in accordance with the present invention. The top and bottom substrates comprise a transparent or an opaque substrate 1, composed of glass, ceramics or other material of about 2 mm in thickness and a transparent substrate 11, composed of glass, plastics or other material of about 2 mm in thickness. Lower electrodes 2 and 12 configure matrix electrodes. The double-insulation-structure EL operating parts consists of: lower insulating layers 3 and 13 composed of oxide, nitride or similar an alternative; a ZnS:Tb (green) luminescent layer 4; and a ZnS:Mn (yellow-orange) luminescent layer 14. Upper insulating layers 5 and 15 are then laminated in sequence. On the upper insulating layers 5 and 15, upper electrodes 6 and 16 configuring matrix electrodes are formed. The lower electrode 12 and the upper electrodes 6 and 16 are ITO electrodes of 2000 Å in thickness formed by sputtering, and a similar lower electrode 2 is a metal electrode of Al, Ni or the alternative of 2000 Å in thickness formed by electron beam evaporation.

To connect to an external driving circuit, an Al/Ni laminated metal film of 2000 Å in thickness is formed on the ITO film at the connection end of the electrodes. Al, the lower electrode 2 may be an ITO transparent film like the others. For the insulating layers 3, 13, 5 and 15, a monolayer film or a laminated layer film selected from $SiO_2$, $Si_3N_4$, $Y_2O_3$, $Al_2O_3$, $Ta_2O_5$, $TiO_2$ and other alternatives is often used. Here, a $Si_3N_4$ film of 2500 Å in thickness is principally used.

A ZnS:Tb film of 7000 Å in thickness formed by sputtering is used for the luminescent layer 4, and a ZnS:Mn film of 7000 Å in thickness formed by electron beam evaporation is used for the luminescent layer 14. Accordingly, the substrate 1 side emits green light and the substrate 11 side emits yellow-orange light. The substrate 11 becomes a display surface, however, since the EL luminescence of the substrate 11 side is radiated in the direction of the display surface and in the direction of the rear surface, the yellow-orange luminescence capable of obtaining a high brightness is used.

Figure 9:
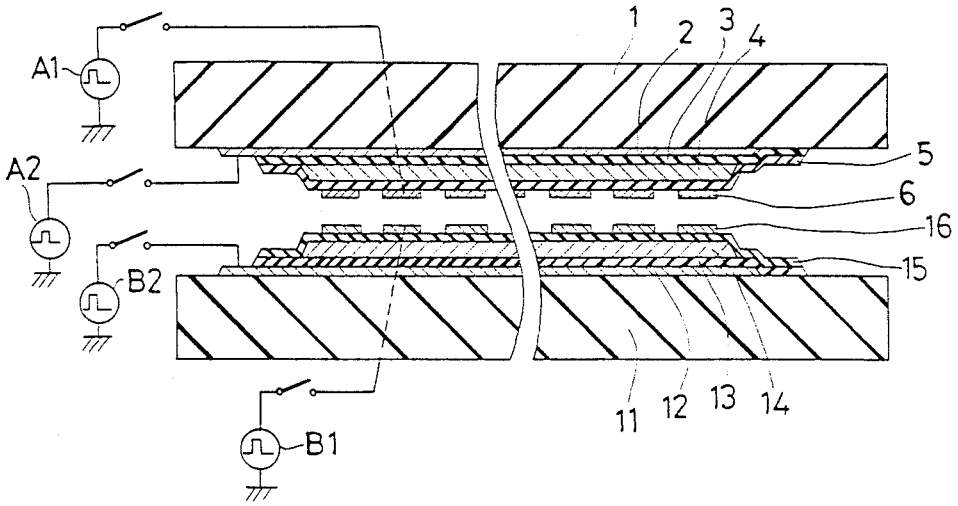
FIG. 9 (PRIOR ART)
FIG. 9 is a configuration diagram showing a conventional thin film EL displaying apparatus.

The principal difference between the thin film EL display panels in FIG. 1 and FIG. 9 is seen in the structure of connection between the electrodes and the driving circuit. As illustrated in FIG. 1, on an electrode line basis the lower electrode 2 and the lower electrode 12 are connected, between the upper and lower thin film EL elements, to a common driving circuit C. On the other hand, the upper electrodes 6 and 16 are connected independently to driving circuit A1 and B1. Accordingly, the number of connection points of the lower electrodes 2 and 12 to the driving circuits is reduced by half.

Figure 2:
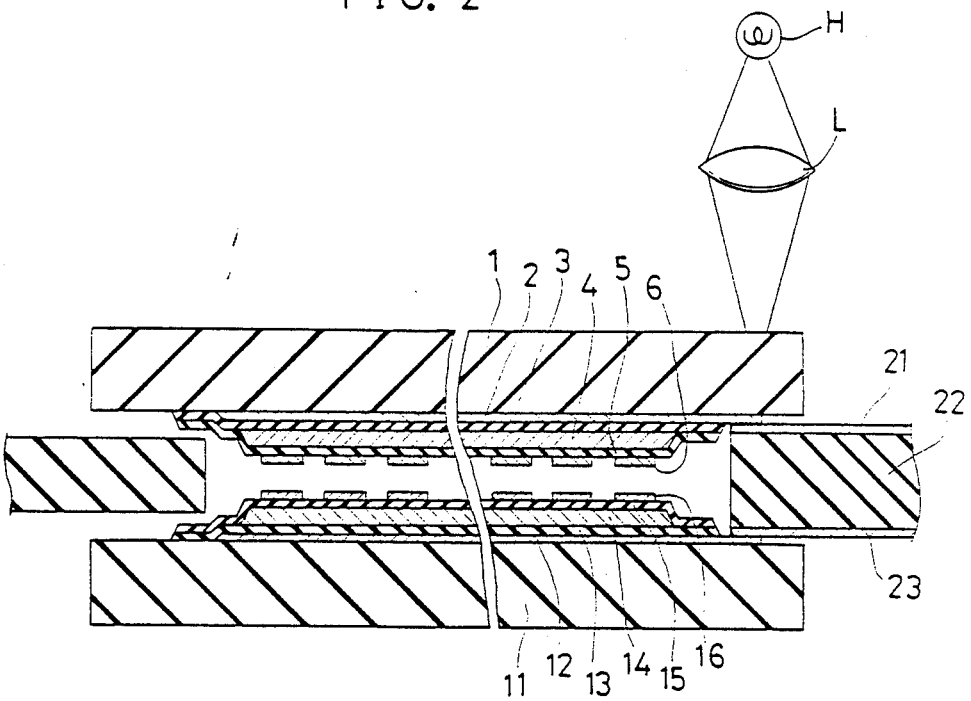

FIG. 2 is a configuration diagram of the thin film EL panel showing another embodiment in accordance with the present invention. In the diagram, the like components as those of FIG. 1 are designated by like symbols. Further, numeral 22 designates an insulating film, and numerals 21 and 23 designate copper films which form wiring patterns on the surface of the insulating film 22. A polyimide film of 100 μm in thickness is used for the insulating film 22.

Figure 3:
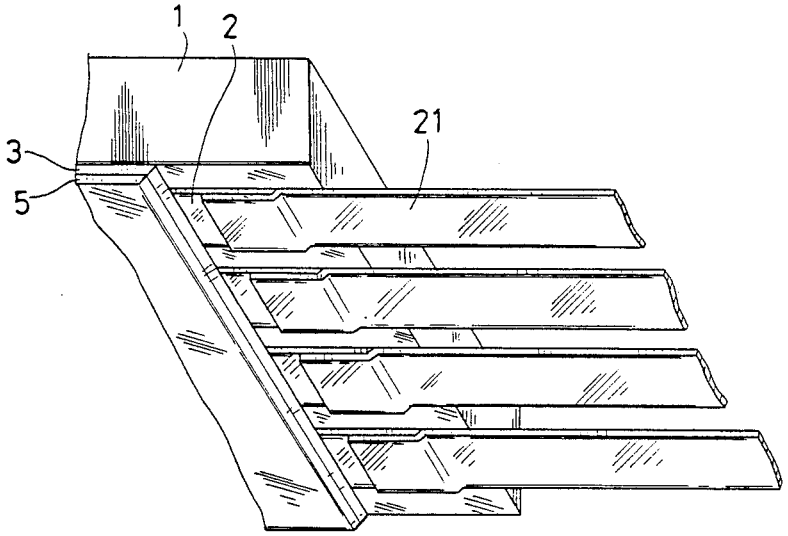
FIG. 3 is a fragmental detailed explanatory view of FIG. 2.
Figure 4:
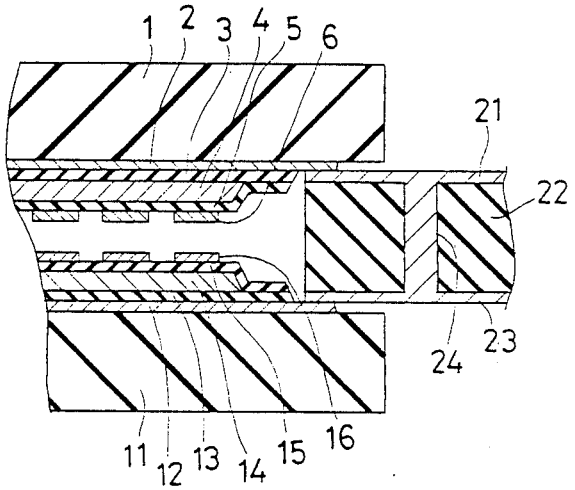
FIG. 4 and FIG. 5 are explanatory views showing modified embodiments in FIG. 2.
Figure 5:
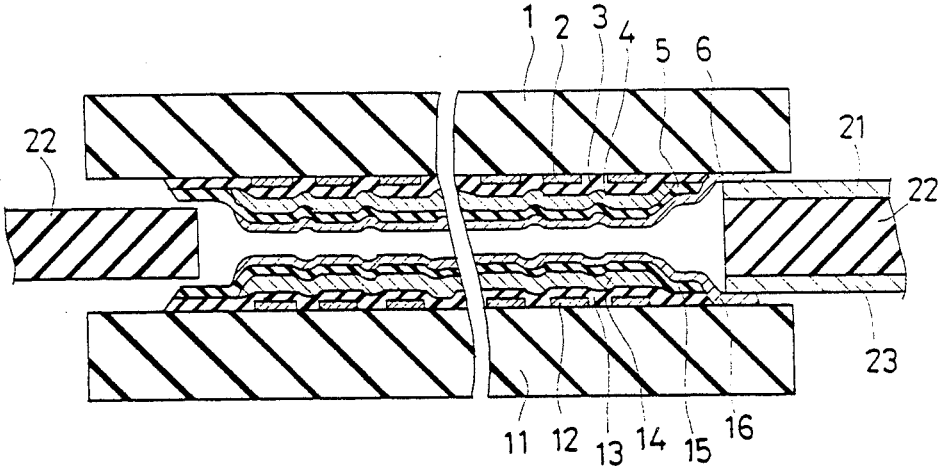

In addition, here, a solder film is formed in advance on the copper film to make an electrical connection to the lower electrodes 2 and 12, and as shown in FIG. 2, by applying pressure from both sides of the substrates 1 and 11. A close attachment is made between the electrode 2 and the copper film 21 and between the electrode 12 and the copper film 23. Light from a heating lamp H is condensed onto the outer surface of the substrate by a lens L to heat the closely attached parts, and thereby solder is melted and the closely attached parts are bonded. This means that by inserting the insulating film 22 as a spacer between the substrates 1 and 11, the lower electrode 2 is connected to the copper film 21 and the lower electrode 12 is connected to the copper film 23, respectively as shown in FIG. 3. As shown in FIG. 4, a through-hole 24 is installed in the insulating film. The copper films 21 and 23 are connected by means of the through-hole and thereby a circuit similar to the FIG. 1 is formed. The copper films 21 and 23 are connected to the external circuit. In addition, as shown in FIG. 5, the copper film 22 can be similarly installed to draw out the upper electrodes 6 and 16.

Figure 6:
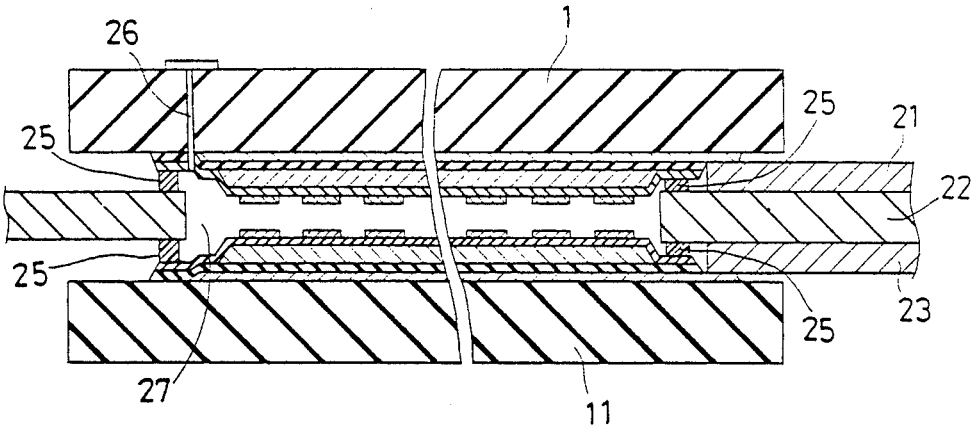

FIG. 6 shows the case where the film 22 for drawing out the electrode terminals in the embodiment in FIG. 2 is used also as a sealing member. Numeral 25 designates an adhesive for connecting the substrates 1 and 11 to the film 22. Numeral 26 designates a hole installed in the substrate 1 to evacuate a closed space 27 or to introduce a hydroscopic agent such as silica gel or an insulating oil thereto.

Figure 7:
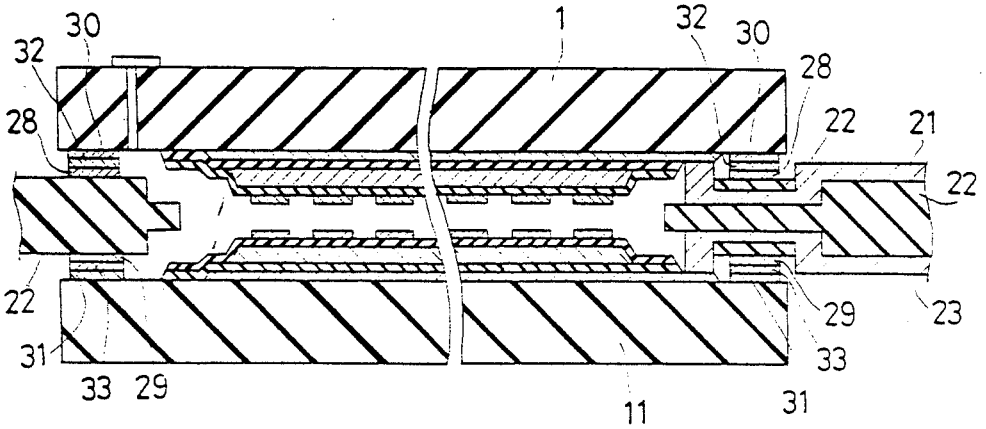

FIG. 7 shows a configuration similar to FIG. 6, and in this case, the bonding positions of the substrates 1 and 11 with the film 22 are changed. The figure shows that the wiring on the film is partly embedded in the film, and copper films 28 and 29 insulated from the copper films 21 and 23 are formed. Thereby, connection by soldering can also be made without an insulating bonding material. Here, Ni films 30 and 31 capable of soldering are formed at the peripheries on the glass substrates so as not to contact the upper and lower electrodes 2, 6, 12 and 16. The copper films 28 and 29 on the film 22 and the Ni films 30 and 31 are connected by solders 32 and 33 respectively.

This technique makes it possible particularly to make electrical connection of the electrodes and mechanical bonding for seal at the same time with the same adhesive (here, solder). This achieves simplification of the process of fabricating the panel.

Figure 8:
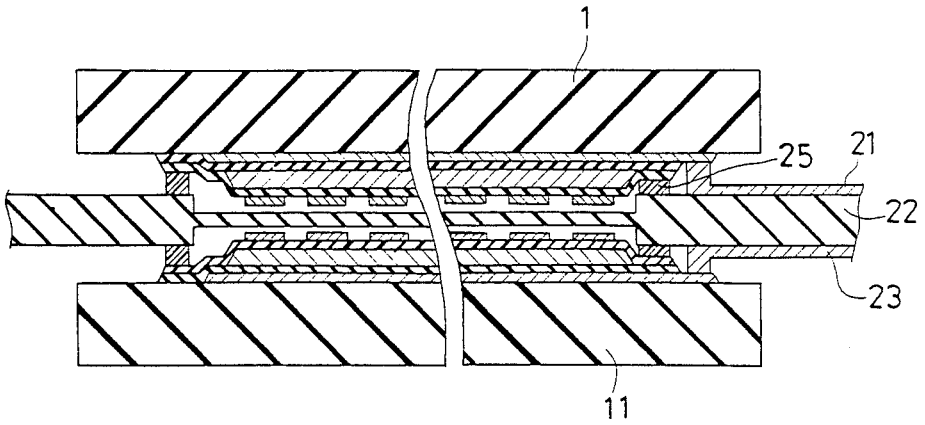

FIG. 8 shows an example of utilizing the above-described film to prevent trouble of a contact of the electrodes 6 and 16 caused by warping of the substrate, which can be expected in the case where the substrate glass is thin. To obtain a better quality of display, a narrower gap is preferable between the display-side substrate glass 1 and the rear-surface-side substrate glass 11. However, in such a case, the electrodes 6 and 16 which face each other are brought into contact when the glasses are warped originally or by an external pressure. To solve this problem, a transparent plastic insulating film is installed at the greater part between each EL element on the glass substrates 1 and 11.

As described above in detail, in accordance with the present invention:

(1) the scanning electrodes of each monochromatic luminescence part are connected between the elements on a corresponding electrode basis, and therefore connections to the driving circuit are reduced in number and the number of parts can be reduced to a great extent which contributes to cost reduction;

(2) by installing a film where wirings are applied on the both surfaces thereof between the substrates, a compact configuration of the multicolored EL panel can be achieved without deteriorating the quality of display; and (3) a function of a spacer for seal can also be given to the above-mentioned film as required, and thereby lower cost and higher productivity are obtainable.

What is claimed is:

1. A multi-layered thin film EL displaying apparatus comprising:

first and second thin film EL elements layered so as to face each other, each including, a substrate, a pair of upper and lower electrodes, an EL layer sandwiched between said upper and lower electrodes, and an insulating means for insulating said EL layer from each of said electrodes;

connecting means, disposed between said first and second thin film EL elements, for electrically connecting a first pair of said electrodes, one from each of said first and second thin film EL elements, to each other and for electrically insulating a second pair of electrodes, one from each of said first and second EL elements;

said connecting means including, an insulating layer for insulating said second pair of electrodes from each other, conductive layers connecting said insulating layer to each one of said first pair of electrodes, and a conductive through-hole in said insulating layer which provides a connection between the conductive layers, and thereby electrically connects said first pair of electrodes with each other.

2. An apparatus, as claimed in claim 1, wherein the electrically connected first pair of electrodes of said first and second thin film EL elements are both upper electrodes.

3. An apparatus, as claimed in claim 1, wherein the electrically connected first pair of electrodes of said first and second thin film EL elements are both lower electrodes.

4. An apparatus, as claimed in claim 1, wherein said electrodes are connected to said conductive layers by means of soldering.

5. A multi-layered thin film EL displaying apparatus, comprising:

first and second thin film EL elements superimposed so as to face each other, each including, a substrate, a pair of upper and lower electrodes, an EL layer sandwiched between said upper and lower electrodes, a first metal film connected to said substrate: and connecting means, sandwiched between said thin film EL elements, for electrically connecting a pair of said electrodes, one from each of said first and second thin film EL elements;

said connecting means including, a first insulating film, operatively connected to said first metal film, a second insulating film, and conductive films laminated on both sides of said second insulating film, for electrically connecting said pair of electrodes.

6. A multi-layered thin film EL displaying apparatus of claim 5, in which each EL element further includes:

a second metal film soldered to said first metal film;

said second metal film, corresponding to each respective substrate, is connected to each respective first insulating film, thereby electrically insulating each of said metal films from each respective conductive film of said connecting means.

7. A multi-layered thin film EL displaying apparatus of claim 5, in which each EL element further includes:

an EL insulating means, sandwiched between each said EL layer and each said upper and lower electrode, for insulating each said EL layer from each said upper and lower electrode.

8. A multi-layered thin film EL displaying apparatus of claim 5, wherein said electrically connected pair of electrodes are upper electrodes.

9. A multi-layered thin film EL displaying apparatus of claim 5, wherein said electrically connected pair of electrodes are lower electrodes.

10. A multi-layered thin film EL displaying apparatus of claim 5, in which the conductive films are disposed at each peripheral part on the upper and lower surfaces of the second insulating film, and said second insulating film is sandwiched between the first and the second thin film EL elements over nearly the whole of the thin film EL elements.

11. A multi-layered thin film EL displaying apparatus of claim 5, in which the second insulating film is sandwiched in a fixed manner between the peripheral parts of the first and the second film EL elements or the first and the second substrate, and a space capable of close seal is formed between the thin film EL elements.

12. A multi-layered thin film EL displaying apparatus of claim 11, in which the substrate provides a hole capable of seal communicating from exterior to the space.

13. A multi-layered thin film EL displaying apparatus of claim 11, in which the space is in a vacuum state.

14. A multi-layered thin film EL displaying apparatus of claim 11, in which the space is filled with a hygroscopic agent such as silica gel or an insulating oil.

15. A multi-layered thin film EL displaying apparatus of claim 5, in which the insulating film is composed of a plastic film of 100–500 μm in thickness.

16. A multi-layered thin film EL displaying apparatus comprising:

first and second thin film EL elements layered so as to face each other, each including, a substrate, a pair of upper and lower electrodes, and an EL layer sandwiched between said upper and lower electrodes; and an insulating film sandwiched at the periphery of the EL elements, conductive films laminated on both sides of said insulating film, the conductive films being electrically connected with the electrodes of the first and second thin film EL elements.

17. A multi-layered thin film EL displaying apparatus of claim 16, wherein a space capable of forming a closed seal is formed between the EL elements.

18. A multi-layered thin film EL displaying apparatus of claim 17, wherein one substrate includes a sealed hole capable of sealing the exterior from the space between the EL elements.

19. A multi-layered thin film EL displaying apparatus of claim 17, wherein the space is in a vacuum state.

20. A multi-layered thin film EL displaying apparatus of claim 17, wherein the space is filled with a hygroscopic agent such as silica gel or an insulating oil.

21. A multi-layered thin film EL displaying apparatus of claim 16, wherein the insulating film is composed of a plastic film of 100–500 μm in thickness.

22. A multi-layered thin film EL displaying apparatus of claim 16, wherein the insulating film is fixed to section of the EL elements by an adhesive.

* * * * *